US006295959B1

(12) United States Patent
Molina et al.

(10) Patent No.: US 6,295,959 B1
(45) Date of Patent: Oct. 2, 2001

(54) EXTERNAL DRIVE DOUBLE SHAFT OVERHEAD CAM ENGINE

(75) Inventors: Roberto Molina, Turin; Luciano Golzio, Torinese; Paolo Mion; Giuseppe Ghelfi, both of Turin, all of (IT)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 09/524,380

(22) Filed: Mar. 13, 2000

Related U.S. Application Data

(60) Provisional application No. 60/125,124, filed on Mar. 19, 1999.

(51) Int. Cl.[7] ..... F01L 1/02

(52) U.S. Cl. ..... 123/90.31; 123/90.27; 123/90.16

(58) Field of Search ..... 123/90.31, 90.27, 123/90.15, 90.16, 90.17, 508, 45 A, 193.5; 474/101

(56) References Cited

U.S. PATENT DOCUMENTS

| | | | | |
|---|---|---|---|---|
| 1,568,615 | | 1/1926 | Parker . | |
| 2,478,106 | | 8/1949 | Jozif | 123/195 |
| 3,418,993 | | 12/1968 | Scheiterlein et al. | 123/195 |
| 3,472,212 | | 10/1969 | Chamberlain | 123/90 |
| 3,738,338 | | 6/1973 | Wickman | 123/90.27 |
| 4,305,352 | * | 12/1981 | Oshima et al. | 123/90.15 |
| 4,395,980 | | 8/1983 | Tominaga et al. | 123/90.27 |
| 4,521,208 | * | 6/1985 | Doveri | 474/101 |
| 4,530,318 | | 7/1985 | Semple | 123/90.17 |
| 4,567,872 | * | 2/1986 | Roosa | 123/508 |
| 4,583,501 | * | 4/1986 | Williams | 123/90.15 |
| 4,633,826 | | 1/1987 | Tominaga et al. | 123/90.31 |
| 4,722,306 | | 2/1988 | Fujikawa et al. | 123/90.2 |
| 4,753,199 | | 6/1988 | Melde-Tuczai et al. | 123/90.31 |
| 4,766,859 | | 8/1988 | Miyaki et al. | 123/196 W |
| 4,864,981 | | 9/1989 | Takada et al. | 123/90.27 |
| 4,873,947 | * | 10/1989 | Ryan, III et al. | 123/90.31 |
| 4,981,120 | | 1/1991 | Mangum, Jr. | 123/149 D |
| 4,993,374 | | 2/1991 | Okui | 123/90.31 |
| 5,022,365 | | 6/1991 | Nariyama | 123/198 R |
| 5,070,686 | | 12/1991 | Isaka et al. | 56/17.5 |
| 5,090,375 | | 2/1992 | Hudson | 123/196 W |
| 5,154,144 | | 10/1992 | Okui et al. | 123/90.27 |
| 5,181,432 | * | 1/1993 | Allen | 123/90.31 |
| 5,209,194 | * | 5/1993 | Adachi et al. | 123/90.17 |

(List continued on next page.)

FOREIGN PATENT DOCUMENTS

| | | |
|---|---|---|
| 3641201 | 6/1987 | (DE) . |
| 0 469 702 | 6/1992 | (EP) . |
| 0 622 534 | 11/1994 | (EP) . |
| 0 653 553 | 5/1995 | (EP) . |
| 62-055403 | 11/1987 | (JP) . |

OTHER PUBLICATIONS

European Search Report dated Jul. 17, 2000, 00105694.4.

*Primary Examiner*—Teresa Walberg
*Assistant Examiner*—Fadi H. Dahbour
(74) *Attorney, Agent, or Firm*—Baker & Daniels

(57) ABSTRACT

An overhead cam engine having a drive train including a crankshaft rotatably disposed within a crankcase and driven by a piston-connecting rod assembly. The crankshaft drives a timing shaft at half the speed of the crankshaft through a gear set within in the crankcase. The timing shaft is parallel to the crankshaft, and has an end extending externally of the crankcase with a timing pulley mounted thereon. The timing pulley is drivingly attached through an external timing belt to a camshaft pulley mounted on an end of a camshaft which extends externally of the cylinder head. The camshaft has a pair of cam lobes mounted thereon inside the cylinder head for actuating intake and exhaust valves within the cylinder head.

22 Claims, 5 Drawing Sheets

U.S. PATENT DOCUMENTS

| | | | | |
|---|---|---|---|---|
| 5,231,961 | | 8/1993 | Shimada et al. | 123/90.27 |
| 5,400,748 | | 3/1995 | Batzill et al. | 123/90.31 |
| 5,417,186 | * | 5/1995 | Elrod et al. | 123/90.17 |
| 5,447,127 | | 9/1995 | Luck et al. | 123/90.31 |
| 5,606,944 | | 3/1997 | Kurihara | 123/90.31 |
| 5,678,516 | | 10/1997 | Sakurai | 123/198 R |
| 5,685,266 | | 11/1997 | Hudson | 123/196 R |
| 5,740,768 | | 4/1998 | Sakurai et al. | 123/90.27 |
| 5,860,402 | | 1/1999 | Sakurai et al. | 123/196 R |
| 5,901,675 | * | 5/1999 | Nakagomi | 123/90.27 |
| 6,125,819 | * | 10/2000 | Strieber et al. | 123/45 A |

* cited by examiner

EXTERNAL DRIVE DOUBLE SHAFT OVERHEAD CAM ENGINE

CROSS REFERENCE TO RELATED APPLICATIONS

This application is related to and claims the benefit under Title 35, U.S.C. § 119(e) of U.S. Provisional Patent Application Ser. No. 60/125,124, entitled EXTERNAL DRIVE DOUBLE SHAFT OVERHEAD CAM ENGINE (DSOHC), filed on Mar. 19, 1999.

BACKGROUND OF THE INVENTION

1. Field of the Invention.

The field of the present invention relates to overhead cam engines, for use in a variety of applications, such as lawnmowers, generators, pumps, tillers, pressure washers and other lawn and garden implements, or in small utility vehicles such as riding lawnmowers, lawn tractors, and the like.

2. Description of the Related Art.

Generally, the intake and exhaust valves of prior known engines are actuated directly by a camshaft located in the cylinder head, or indirectly through the use of rocker arms, tappets, or other similar means. For example, in many existing L-head and overhead valve engines, the crankshaft drives a camshaft which is parallel to the crankshaft and located in the crankcase, and lobes on the camshaft actuate push rods and rocker arms to open and close the valves.

Another arrangement is illustrated in U.S. Pat. No. 5,090,375, assigned to the assignee of the present application, and is hereby incorporated by reference, in which the crankshaft extends externally of the crankcase and the camshaft extends externally of the cylinder head. The camshaft is driven by the crankshaft by means of a belt and pulley, chain and sprocket or the like at one half the rotational speed of the crankshaft. Such speed reduction is typically achieved by mounting a pulley or sprocket on the camshaft that is twice as large as the pulley or sprocket on the crankshaft.

A problem with this and similar designs is that the pulley or sprocket is mounted directly on the portion of the crankshaft which extends from the crankcase, which produces a high force moment on the end of the crankshaft and stress on the crankshaft bearing. To compensate for the stress, the crankshaft bearing must be enlarged and/or the crankcase wall reinforced around the bearing, which increases the cost and size of the crankcase.

An additional problem is that speed reduction is accomplished outside of the crankcase by means of the pulley or sprocket mounted on the camshaft which is twice as large as the pulley or sprocket mounted on the crankshaft. The large pulley or sprocket on the camshaft increases the overall size of the cylinder head and length of the engine.

What is needed is an engine in which the camshaft is not driven directly from the crankshaft, to reduce the stress on the crankshaft bearing and obviate the need for a larger bearing and/or reinforcement of the crankcase wall around the bearing.

A further need is for an engine in which the speed reduction is carried out within the crankcase by the same reduction gearing as in overhead valve and L-head engines, such that a smaller pulley may be to be mounted on the camshaft to reduce the size of the cylinder head and length of the engine and to utilize existing bearings in the crankcase.

A still further need is for an engine in which the above needs are accomplished, yet may be manufactured using existing components and tooling.

SUMMARY OF THE INVENTION

The present invention provides a drive train for an overhead cam engine, including a timing shaft parallel to the crankshaft which is driven by the crankshaft at one half crankshaft speed through a gear set within the crankcase. An end of the timing shaft extends externally of the crankcase, and has a pulley mounted thereon for driving a camshaft pulley mounted on an end of a camshaft that extends outside of the cylinder head through a belt connecting the timing shaft pulley to the camshaft pulley. The bearing and reduction gear set are disposed on the opposite end of the timing shaft and located on the opposite side of the crankcase with respect to the timing shaft pulley.

An advantage of this arrangement is that carrying out the speed reduction through a gear set within the crankcase reduces the end force on the crankshaft and the stress on the crankshaft bearings, which in turn reduces cost by obviating the need for a larger crankcase bearing and/or reinforcement of the crankcase wall around the bearing, therefore allowing a crankshaft of smaller diameter and a thinner crankcase wall.

Another advantage is that the speed reduction within the crankcase, provided by the timing shaft and gear set, eliminates the need for a pulley on the camshaft that is twice as large as the pulley on the crankshaft, which reduces the size of the cylinder head and the length of the engine.

In addition, because many existing L-head and overhead valve engines already include an internal camshaft driven by the crankshaft through a gear set, such engines can conveniently be modified for overhead cam operation by replacing the camshaft with a timing shaft and extending the timing shaft through the crankcase wall so that a timing belt or chain can extend from the timing shaft to the camshaft externally of the crankcase. This enables the utilization of existing tooling and engine components, thereby significantly reducing the cost of the engine.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
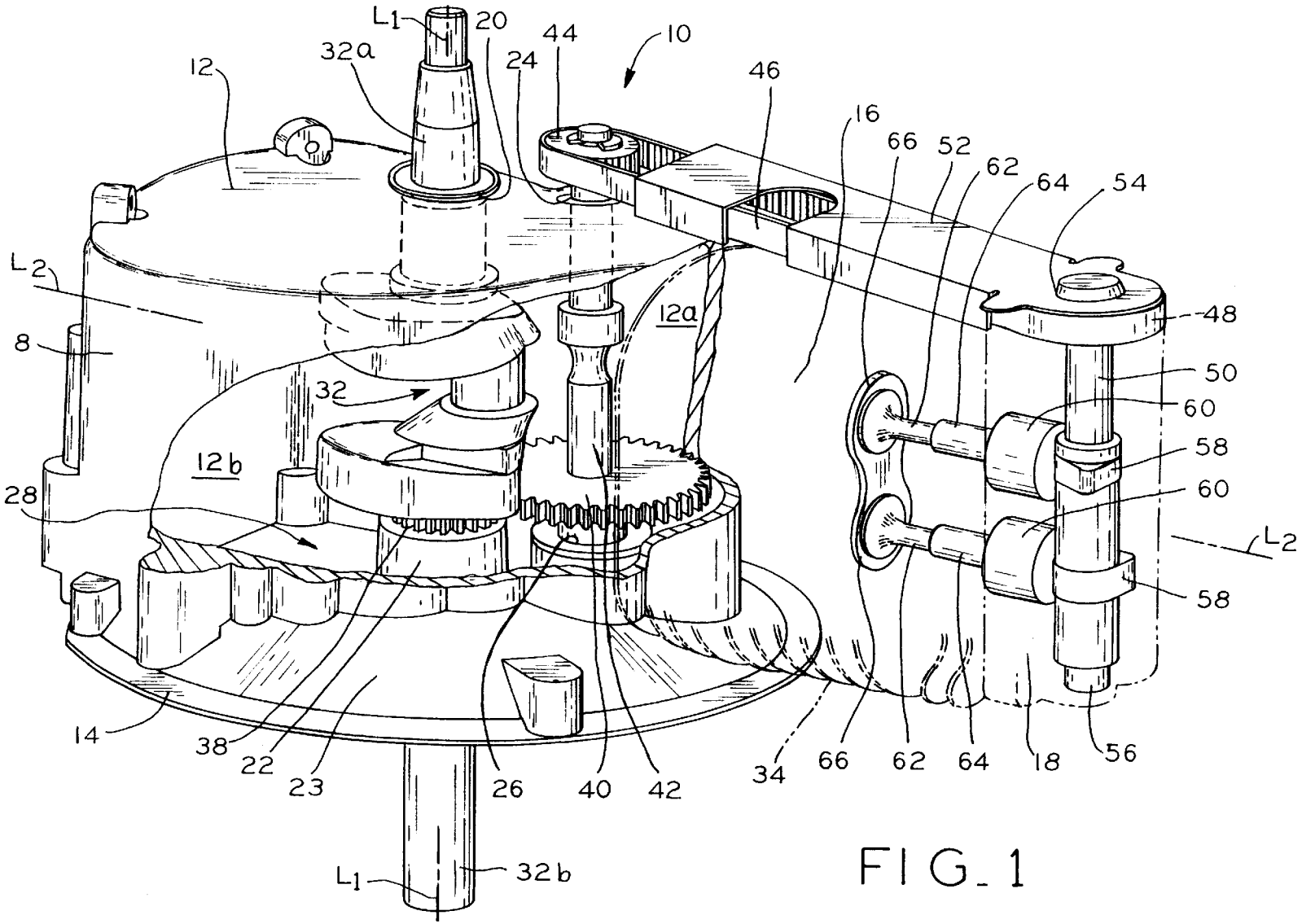
FIG. 1 is a perspective cutaway view of an overhead cam engine, showing the crankshaft, timing shaft with timing gear and timing pulley, timing belt, camshaft and camshaft pulley, with the crankcase, cylinder block and cylinder head partially shown.

Referring to FIGS. 1, 4, 5 and 6, part of the drive train 10 of an overhead cam engine, which can be either a vertical crankshaft or horizontal crankshaft type engine, is shown. Drive train 10 is generally enclosed within crankcase 8, mounting flange or crankcase base 14, cylinder block 16, cylinder head 18, and valve head cover 19. Crankcase 8 generally comprises crankcase base 14 and crankcase upper casing 12, where the upper portion of casing 12 defines a first side 12*a* of crankcase 8, and the lower portion of casing 12 and crankcase base 14 defines a second side 12*b* of crankcase 8 opposite the first side of crankcase 8. Crankcase casing 12 includes upper crankshaft bearing 20 and upper timing shaft bearing 24. Crankcase base 14 includes lower crankshaft bearing 22, lower timing shaft bearing 26, mounting flange 23, and oil sump 28. Crankcase casing 12 and crankcase base 14 are attached in a conventional manner.

Figure 4:
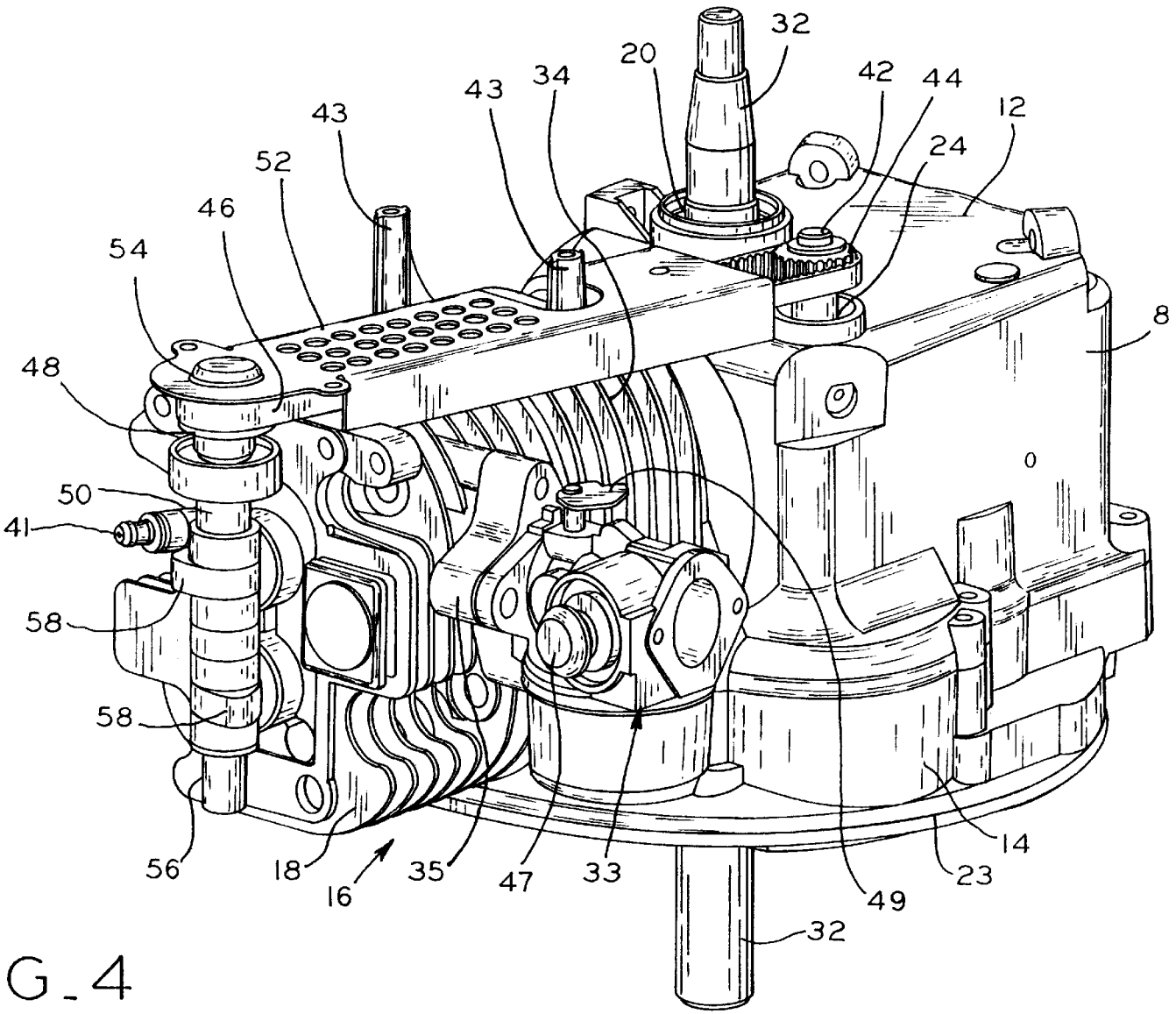
FIG. 4 is a perspective view of the engine.
Figure 5:
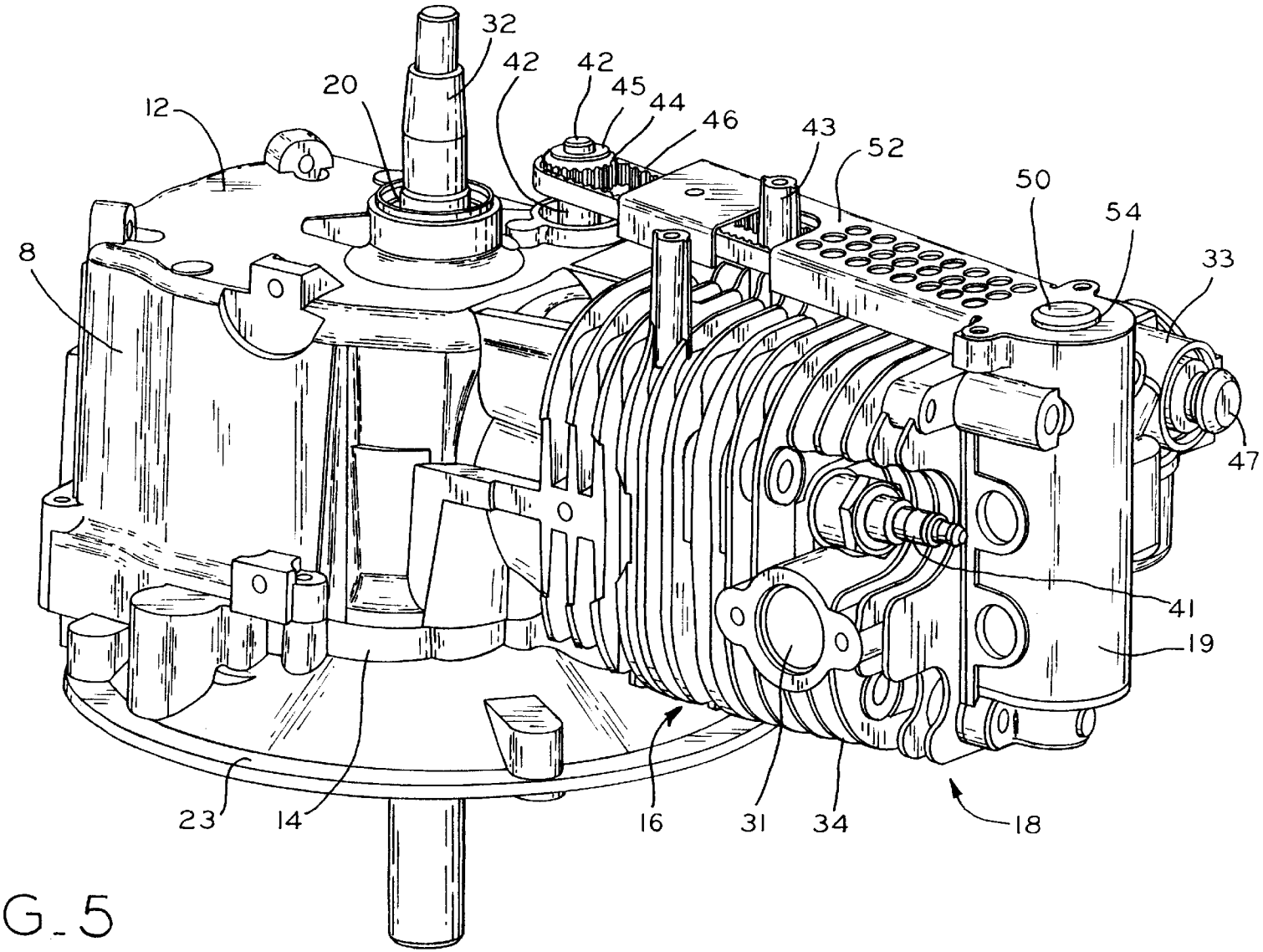
FIG. 5 is a further perspective view of the engine taken from the opposite side.
Figure 6:
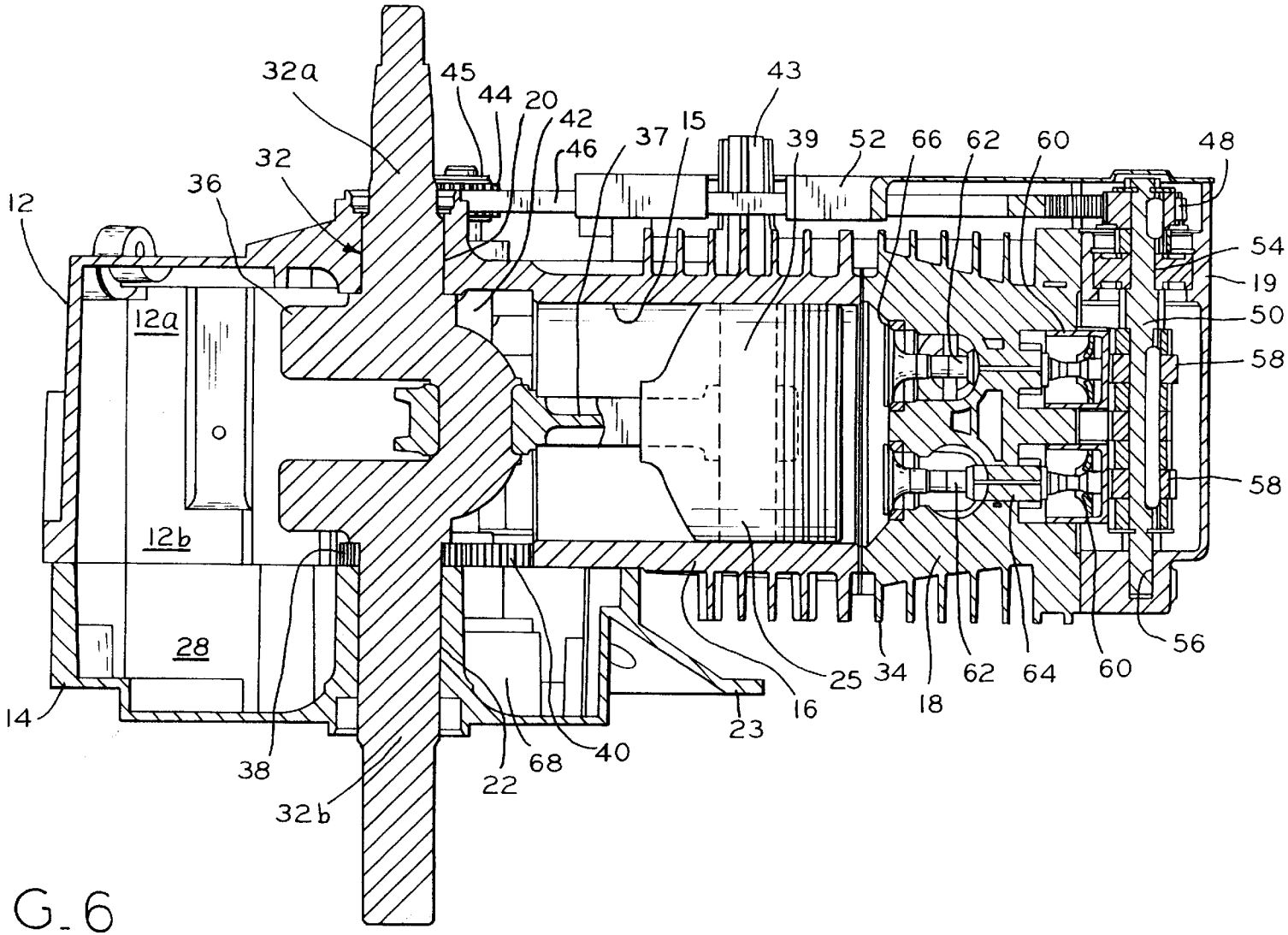
FIG. 6 is a longitudinal sectional view of the engine.

Journals 32*a* and 32*b* of crankshaft 32 are rotatably carried in upper and lower crankshaft bearings 20 and 22, respectively, and crankshaft 32 is disposed along an axis $L_1$—$L_1$. Piston 25 (FIG. 6) is slidably received in cylinder bore 15 within cylinder block 16 along an axis $L_2$—$L_2$, perpendicular to crankshaft axis $L_1$—$L_1$. Cylinder block 16 has integral supports 43 for mounting an electric ignition module (not shown) thereon, and integral cooling fins 34 for dissipating heat. As shown in FIG. 6, connecting rod 37 is rotatably connected to piston 25 by wrist pin 39, and is also rotatably connected to crankshaft 32 between throws 36 in a conventional manner. A flywheel, recoil starter, and blower (not shown) are secured to crankshaft 32. A conventional muffler (not shown) is connected to exhaust port 31 (FIG. 5) and carburetor 33 is connected to intake port 35 (FIG. 4). Carburetor 33 includes breather 47 and throttle lever 49 connected to governor linkage (not shown). As may be seen in FIGS. 4 and 5, intake port 35 and exhaust port 31 extend inwardly into cylinder head 18 on opposite sides of cylinder head 18 in a cross flow orientation. Spark plug 41 is received within cylinder head 18.

Drive gear 38, secured to crankshaft 32 between upper and lower crankshaft bearings 20 and 22 and disposed in the second or lower side 12*b* of crankcase 8, is driven by crankshaft 32, and drive gear 38 drives timing gear 40, which is twice the diameter of drive gear 38. Timing gear 40 is secured to timing shaft 42, which is rotatably carried in upper and lower timing shaft bearings 24 and 26, respectively, and extends substantially completely across crankcase 8. Timing gear 40 is disposed in the lower side of crankcase 8. Therefore, crankshaft 32 is directly rotatably coupled to timing shaft 42, via drive gear 38 and timing gear 40, at a location in crankcase base 14, and crankshaft 32 drives timing shaft 42 at half the speed of crankshaft 32 through a gear set including drive gear 38 and timing gear 40. Timing shaft 42 is disposed parallel to crankshaft axis $L_1$—$L_1$, and extends externally out of crankcase first or upper side 12*a* at one end, on which is secured a drive member in the form of toothed timing shaft pulley 44 held in place by snap ring 45 (FIGS. 5 and 6). Timing shaft pulley 44 drives toothed timing belt 46 and toothed camshaft pulley 48 (FIGS. 4 and 6) which is secured to an end of camshaft 50 which extends externally of cylinder head 18. Alternatively, other endless loop drives can be employed, such as a chain and sprocket mechanism (not shown).

Belt guard 52 substantially covers timing belt 46, and is fixed to cylinder head 18 and crankcase casing 12. As shown in FIGS. 1 and 4–6, a portion of timing belt 46 around timing shaft pulley 44 is not covered by belt guard 52 but rather is exposed.

Camshaft 50 is carried in upper and lower camshaft bearings 54 and 56, respectively, within cylinder head 18, and is disposed along an axis substantially parallel to crankshaft axis $L_1$—$L_1$. Camshaft 50 has spaced cam lobes 58 which periodically actuate tappets 60 as camshaft 50 rotates. Tappets 60 are connected to valves 62 extending through valve guides 64 within the cylinder head 18. Valves 62 seat against valve seats 66 which are press-fitted into cylinder head 18.

Figure 2:
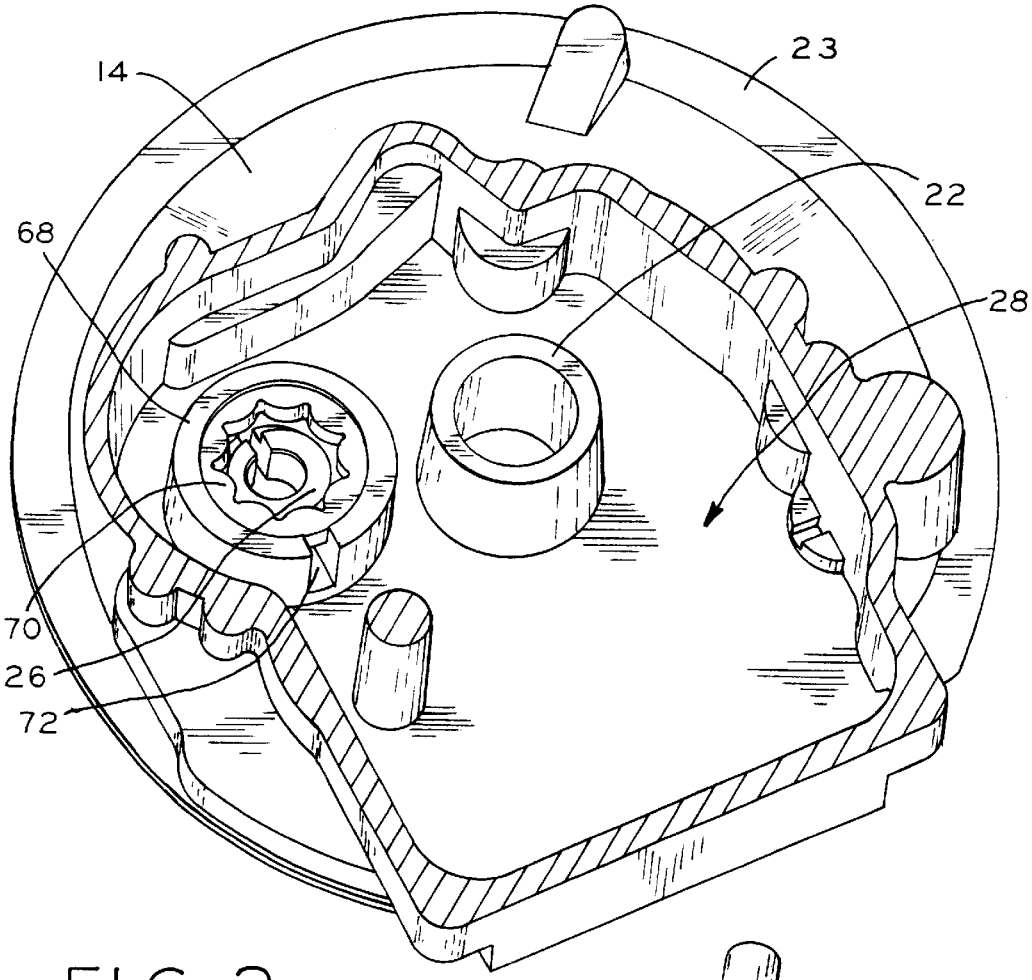
FIG. 2 is a perspective fragmentary sectional view of the crankcase, showing the lower crankshaft bearing, oil sump, lower timing shaft bearing, and gerotor oil pump.

As piston 25 reciprocates, crankshaft 32 drives timing gear 40 at half crankshaft speed, which in turn drives timing shaft 42, timing pulley 44, timing belt 46, camshaft pulley 48, and camshaft 50 at a rotational speed equal to timing gear 40. Referring to FIG. 2, crankcase base 14 includes integral lower crankshaft bearing 22, and lower timing shaft bearing 26 located within oil pump housing 68. Oil pump housing 68 encloses a conventional gerotor oil pump (or similar pump), including external rotor 70 within oil pump housing 68 which is disposed above lower timing shaft bearing 26.

Figure 3:
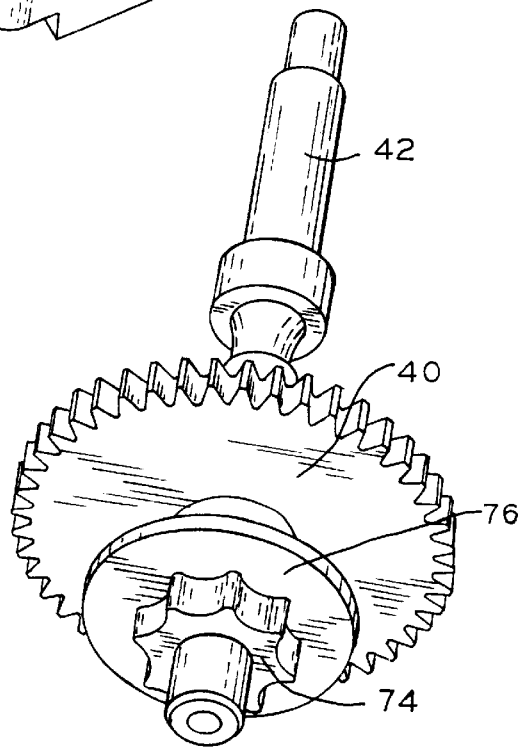
FIG. 3 is a perspective view of the timing shaft, showing the timing gear, gerotor oil pump inner rotor, and oil pump cover.

Timing shaft 42 is shown in FIG. 3, on which is secured timing gear 40, internal rotor 74 and cover 76, which closes oil pump housing 68. As timing gear 40 and timing shaft 42 are driven by crankshaft 32, internal rotor 74 operatively engages external rotor 70, thereby drawing oil from oil sump 28 through oil inlet 72, and pumping oil throughout the engine via oil passageways (not shown).

Because timing gear 40 is driven by crankshaft 32 at a position adjacent lower crankshaft bearing 22, existing, standard size crankshaft bearings are sufficient to handle the torque involved. This is in contrast with the conventional technique for driving a timing belt wherein a pulley is disposed on the end of the crankshaft external of the crankcase. In such an arrangement, the force moment on the end of the crankshaft is sufficiently large to require a larger bearing and a thicker or reinforced crankcase wall.

As described above, speed reduction between crankshaft 32 and camshaft 50 occurs within crankcase 8, thereby enabling camshaft pulley 48 to be the same diameter as timing shaft pulley 44. This reduces significantly the size of cylinder head 18 and valve head cover 19, and also the length of the engine as measured from crankshaft 32 to the top of the valve head cover 19. This reduced engine silhouette is important in applications where space is at a premium, such as in walk behind lawnmowers.

While the present invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An overhead cam engine, comprising:

a crankcase having a first side and an opposite second side;

a cylinder head attached to said crankcase;

a crankshaft rotatably disposed in said crankcase, said crankshaft driven by a piston and connecting rod assembly;

a timing shaft rotatably disposed in a first bearing in said first side of said crankcase and in a second bearing in said second side of said crankcase, said timing shaft directly rotatably coupled to said crankshaft at a location in said second side, said timing shaft having an end extending externally out of said first side of said crankcase;

a camshaft rotatably disposed in said cylinder head and actuating a pair of valves, said camshaft having an end extending externally out of said cylinder head; and drive linkage disposed externally of said crankcase and connecting said timing shaft and said camshaft.

2. The engine of claim 1, wherein said timing shaft and said crankshaft are directly rotatably coupled through a gear set disposed in said second side of said crankcase.

3. The engine of claim 1, wherein said crankshaft and said timing shaft are each disposed along respective substantially vertical axes, and said piston and connecting rod assembly is disposed along a substantially horizontal axis.

4. The engine of claim 1, wherein said drive linkage comprises:

a timing pulley mounted on said end of said timing shaft extending externally of said crankcase;

a camshaft pulley mounted on said end of said camshaft extending externally of said cylinder head; and a timing belt connecting said timing pulley and said camshaft pulley.

5. The engine of claim 4, wherein said timing pulley said camshaft pulley have the same diameter.

6. The engine of claim 5, wherein said timing belt, said timing pulley, and said camshaft pulley are toothed.

7. The engine of claim 4, wherein said timing belt is substantially covered by a belt guard, said belt guard attached to said crankcase and said cylinder head.

8. The engine of claim 1, wherein said crankshaft and said timing shaft are coupled by a gear set and said gear set includes a drive gear mounted on said crankshaft, said drive gear driving a timing gear mounted on said timing shaft.

9. The engine of claim 8, wherein said timing gear is twice the diameter of said drive gear, such that said timing shaft is driven at half the speed of said crankshaft.

10. The engine of claim 1, wherein said crankcase includes a base with an oil pump disposed therein, said oil pump driven by said timing shaft.

11. The engine of claim 1, wherein said cylinder head includes intake and exhaust ports extending inwardly into opposite sides of said cylinder head in a cross flow orientation.

12. An overhead cam engine, comprising:

a crankcase having a first side and an opposite second side;

a crankshaft and a timing shaft rotatably disposed in said crankcase, said timing shaft parallel to said crankshaft and extending substantially completely across said crankcase, said timing shaft directly rotatably coupled to said crankshaft at a location in said second side and extending out said first side;

a piston and connecting rod assembly driving said crankshaft;

a cylinder head having a camshaft rotatably disposed therein, said camshaft actuating valves in said cylinder head;

an endless loop drivingly connecting a pair of drive members, one said drive member mounted on an end of said timing shaft which extends externally of said first side of said crankcase, and the other said drive member mounted on an end of said camshaft which extends externally of said cylinder head.

13. The engine of claim 12, wherein said timing shaft and said crankshaft are directly rotatably coupled through a gear set.

14. The engine of claim 12, wherein said crankshaft and said timing shaft are disposed along respective substantially vertical axes and said piston and connecting rod assembly are disposed along a substantially horizontal axis.

15. The engine of claim 13, wherein said gear set comprises:

a drive gear mounted on said crankshaft; and a timing gear mounted on said timing shaft, said timing gear twice the diameter of said drive gear such that said crankshaft drives said timing shaft at half the speed of said crankshaft.

16. The engine of claim 12, wherein said drive members are pulleys of equal diameter, said endless loop is a toothed belt, and said pulleys and said belt are toothed.

17. The engine of claim 16, wherein said belt is substantially covered by a belt guard attached to said crankcase and said cylinder head.

18. The engine of claim 16, wherein said timing shaft drives an oil pump disposed in said crankcase.

19. The engine of claim 12, wherein said cylinder head includes inwardly extending intake and exhaust ports on opposite sides of said cylinder head in a cross flow orientation.

20. An overhead cam engine, comprising:

a crankcase having a first side and an opposite second side;

a crankshaft rotatably disposed in said crankcase along a substantially vertical axis, said crankshaft having a drive gear mounted thereon, said drive gear disposed in said second side of said crankcase;

a timing shaft parallel to said crankshaft, said timing shaft rotatably disposed in a first bearing in said first side of said crankcase and in a second bearing in said second side of said crankcase, said timing shaft having a timing gear mounted thereon, said timing gear disposed in said second side of said crankcase and driven by said drive gear at half the speed of said crankshaft;

a cylinder block having a cylinder bore therein disposed along a substantially horizontal axis, said cylinder bore receiving a piston therein, said piston drivingly connected to said crankshaft;

a cylinder head with a camshaft rotatably disposed therein, said camshaft actuating a pair of valves in said cylinder head;

a timing pulley mounted on an end of said timing shaft extending externally out of said first side of said crankcase;

a camshaft pulley mounted on an end of said camshaft extending externally of said cylinder head; and a timing belt connecting said timing pulley and said camshaft pulley.

21. The engine of claim 20, wherein said timing pulley and said camshaft pulley are equal in diameter.

22. The engine of claim 20, wherein said timing pulley, said camshaft pulley, and said timing belt are toothed.

* * * * *

UNITED STATES PATENT AND TRADEMARK OFFICE

CERTIFICATE OF CORRECTION

PATENT NO. : 6,295,959 B1
DATED : October 2, 2001
INVENTOR(S) : Roberto Molina et al.

It is certified that error appears in the above-identified patent and that said Letters Patent is hereby corrected as shown below:

Column 5,
Line 25, after "pulley" insert -- and --
Line 30, after "guard" insert -- being --

Column 6,
Line 14, after "gear" insert -- having --

Signed and Sealed this

Sixteenth Day of July, 2002

*Attest:*

*Attesting Officer*

JAMES E. ROGAN
*Director of the United States Patent and Trademark Office*